US006932042B2

(12) United States Patent
Murata et al.

(10) Patent No.: US 6,932,042 B2
(45) Date of Patent: Aug. 23, 2005

(54) STARTER HAVING PINION-ROTATION-RESTRICTING MEMBER FOR USE IN AUTOMOTIVE VEHICLE

(75) Inventors: Mitsuhiro Murata, Niwa-gun (JP); Masami Niimi, Handa (JP); Tsutomu Shiga, Nukata-gun (JP); Masanori Ohmi, Anjo (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/718,675

(22) Filed: Nov. 24, 2003

(65) Prior Publication Data

US 2004/0107932 A1 Jun. 10, 2004

(30) Foreign Application Priority Data

Dec. 6, 2002 (JP) ..... 2002-355896

(51) Int. Cl.[7] ..... F02N 11/00
(52) U.S. Cl. ..... 123/179.25; 74/7 A; 290/48
(58) Field of Search ..... 123/179.5; 74/7 R, 74/7 A, 7 B, 7 E; 290/38 R, 48

(56) References Cited

U.S. PATENT DOCUMENTS 5,233,877 A * 8/1993 Campbell ..... 74/7 E
5,789,821 A 8/1998 Shiga et al.
2004/0108727 A1 * 6/2004 Kurasawa et al. ..... 290/38 R

FOREIGN PATENT DOCUMENTS

| | | |
|---|---|---|
| EP | 0 781 919 A1 | 7/1997 |
| EP | 1 353 065 A2 | 10/2003 |
| JP | A 9-217672 | 8/1997 |
| JP | A 10-18950 | 1/1998 |

OTHER PUBLICATIONS

U.S. Appl. No. 10/701,487, filed Nov. 6, 2003, Kurasawa et al.

* cited by examiner

*Primary Examiner*—Andrew M. Dolinar
(74) *Attorney, Agent, or Firm*—Oliff & Berridge, PLC

(57) ABSTRACT

A pinion gear of a starter is engaged with a ring gear of an internal combustion engine by restricting rotation of the pinion gear while driving a motor at a low speed. After the engagement is established, the motor is driven at a full speed by supplying a full current, thereby cranking up the engine. A crank bar for transferring movement of a plunger in a magnetic switch to a pinion-rotation-restricting member is divided into two or three portions. After the divided portions are assembled to the starter, they are connected together to form a solid piece. In this manner, a process of assembling the crank bar into the starter is simplified.

3 Claims, 3 Drawing Sheets

STARTER HAVING PINION-ROTATION-RESTRICTING MEMBER FOR USE IN AUTOMOTIVE VEHICLE

CROSS-REFERENCE TO RELATED APPLICATION

This application is based upon and claims benefit of priority of Japanese Patent Application No. 2002-355896 filed on Dec. 6, 2002, the content of which is incorporated herein by reference.

BACKGROUND OF THE INVENTION

1. Field of the Invention

The present invention relates to a starter for use in an automotive vehicle, the starter having a pinion-rotation-restricting member for engaging a pinion gear with a ring gear of an internal combustion engine.

2. Description of Related Art

Examples of the starter of this kind are disclosed in JP-A-9-217672 and JP-A-10-18950. A pinion gear coupled to an output shaft of an electric motor by means of a helical spline is shifted toward a ring gear of an internal combustion engine while restricting rotation of the pinion gear. In this manner, the pinion gear engages with the ring gear of the engine, and the engine is cranked up by the electric motor. Rotation of the pinion gear is restricted by a pinion-rotation-restricting member that is operated by a crank bar which is in turn driven by a plunger of a magnetic switch.

The crank bar extends from the rear side of the starter to the front side to operate the pinion-rotation-restricting member positioned at the front side by the magnetic switch positioned at the rear side. Accordingly, it is unavoidable to make the crank bar considerably long. Further, both ends of the crank bar are bent from its straight portion. Therefore, it has been difficult to assemble the starter sequentially from one side of the starter, e.g., from the front side. As a result, the starter has been assembled in a time-consuming manner. In addition, both ends of the crank bar have to be correctly bent at a predetermined angle and connected to the plunger at a precise position. Therefore, a process of manufacturing the crank bar has not been simple.

SUMMARY OF THE INVENTION

The present invention has been made in view of the above-mentioned problems, and an object of the present invention is to provide a starter having a member for restricting pinion rotation, in which a crank bar for operating the pinion-rotation-restricting member is easily assembled in the starter. Another object of the present invention is to provide the crank bar that is easily manufactured.

The starter includes an electric motor, a magnetic switch and a pinion gear driven by the electric motor. In the process of operating the starter, the magnetic switch is first energized by closing an ignition switch. A plunger in the magnetic switch is driven upon energization of the magnetic switch. In response to movement of the plunger, an auxiliary switch for supplying a small amount of current to the armature of the motor is closed. The armature rotates at a low speed upon closing the auxiliary switch. At the same time, the plunger drives a crank bar which in turn brings a pinion-rotation-restricting member into engagement with the pinion gear. Thus, the rotation of the pinion gear is restricted. The restricted pinion gear which is spline-coupled to an output shaft of the motor is pushed toward a ring gear of an internal combustion engine, thereby bringing the pinion gear into engagement with the ring gear.

After the pinion gear engages with the ring gear, the pinion gear is released from the restriction. The stroke of the plunger further proceeds, and a main switch for supplying a full current to the armature is closed. The armature rotates at a full speed, thereby cranking up the engine. After the engine is cranked up, the pinion gear is shifted back to its original position, disengaging with the ring gear. At the same time, current supply to the armature is terminated. Thus, the operating process of the starter is completed.

The crank bar used in the starter for transferring the plunger movement to the pinion-rotation-restricting member is divided into two or three portions. After the respective portions are assembled to the starter at respectively right positions, they are firmly connected to each other, thereby forming a unitary piece of the crank bar. The crank bar is composed of a rod portion extending in the axial direction of the starter, a coupling portion coupling the crank bar to the plunger, and an operating portion contacting the pinion-rotation-restricting member.

The crank bar may be divided into two portions, a first portion consisting of the rod portion and the operating portion and a second portion consisting of the operating portion; or a first portion consisting of the rod portion and the coupling portion and a second portion consisting of the operating portion. Alternatively, the crank bar may be divided into three portions, i.e., the rod portion, the coupling portion and the operating portion. The divided portions can be made of respectively different materials, can be separately heat-treated to harden only the desired portions, or can be formed to have respectively different cross-sections.

According to the present invention, not only the crank bar itself is easily manufactured but also it is easily assembled to the starter, thereby reducing the manufacturing cost of the starter. Other objects and features of the present invention will become more readily apparent from a better understanding of the preferred embodiment described below with reference to the following drawings.

DETAILED DESCRIPTION OF THE PREFERRED EMBODIMENT

Figure 1:
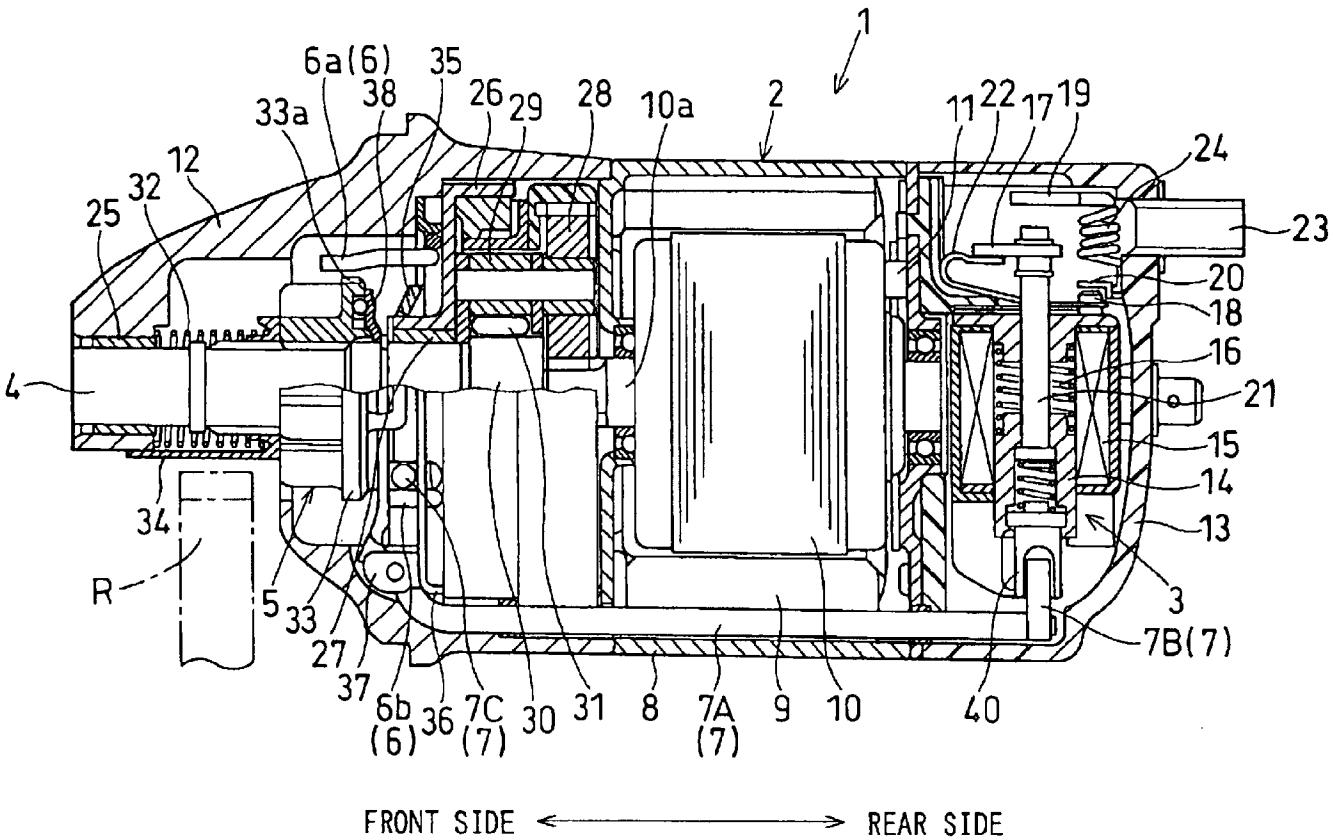
FIG. 1 is a cross-sectional view showing a starter according to the present invention.

A preferred embodiment of the present invention will be described with reference to FIGS. 1–4. As shown in FIG. 1, a starter 1 of the present invention includes: an electric motor 2; a magnetic switch 3 for supplying current to the motor 2 in an on-and-off fashion; an output shaft 4 driven by the motor 2; a pinion gear 5 slidably coupled to the output shaft 4; a pinion-rotation-restricting member 6 that restricts rotation of the pinion gear 5 to establish engagement between the pinion gear 5 and a ring gear R of an internal combustion engine; a crank bar 7 that is driven by the magnetic switch 3 and pushes the pinion-rotation-restricting member 6 into an engagement position with the pinion gear 5; and other associated components.

The electric motor 2 is a known type of a direct current motor. The motor 2 is composed of a yoke 8, poles 9 formed by permanent magnets, an armature 10, brushes 11 and other associated components. Upon closing motor contacts (in a manner explained below) by the magnetic switch 3, electric current is supplied from an on-board battery to the armature 10 through the brushes 11, generating a rotational torque in the armature 10. The motor 2 is contained in a space confined by a front housing 12 and a rear end cover 13. The front side and the rear side of the starter 1 are shown in FIG. 1.

The magnetic switch 3 including a plunger 14 that is driven in a direction perpendicular to an axial direction of the output shaft 4 is positioned at a rear side of the starter 1. As shown in FIG. 1, the magnetic switch 3 is composed of: a solenoid 15 that is energized when current is supplied thereto from the on-board battery upon turning on an ignition switch; the plunger 14 disposed in an inner bore of the solenoid 15 so that the plunger 14 is driven upward upon energization of the solenoid 15; and a plunger-return spring 16 that biases the plunger 14 toward its initial position.

A main movable contact 17 and an auxiliary movable contact 18 are held on a plunger rod 21 that is connected to the plunger 14. The main movable contact 17 is electrically connected to a plus side brush 11 through a lead wire (not shown). The auxiliary movable contact 18 is electrically connected to the main movable contact 17 through a copper plate 22 that also serves to give resiliency to the main movable contact 17. A main stationary contact 19 facing the main movable contact 17 is formed integrally with a terminal bolt 23 that is mounted on a rear end cover 13. An auxiliary stationary contact 20 facing the auxiliary movable contact 18 is supported on the rear end cover 13 and is electrically connected to the main stationary contact 19 through a starting resistor 24. The main movable contact 17 and the main stationary contact 19 constitute a main switch, and the auxiliary movable contact 18 and the auxiliary stationary contact 20 constitute an auxiliary switch. The starting resistor 24 is, for example, a nickel wire wound in a coil shape and serves to restrict an amount of current supplied the armature 10 when the auxiliary switch is closed. A distance between the main movable contact 17 and the main stationary contact 19 is made longer than a distance between the auxiliary movable contact 18 and the auxiliary stationary contact 20, when the plunger 14 is at its initial position (FIG. 1 shows the initial position).

The output shaft 4 is disposed at the front side of the motor 2 coaxially with an armature shaft 10*a*. The output shaft 4 is rotatably supported by a bearing 25 fixed to the front housing 12 and another bearing 27 fixed to a center case 26. A rotational torque of the armature 10 is transferred to the output shaft 4 via a speed reduction device and a one-way clutch in a manner described below. The center case 26 is disposed inside the front housing 12 at the front side of the yoke 8, and the speed reduction device and the one-way clutch are disposed in the center case 26.

The speed reduction device is a known one that reduces a rotational speed of the armature 10 through planetary gears 28 orbiting around a center gear, and transfers the reduced speed to the output shaft 4 through the one-way clutch. The speed reduction device of this type is called a planetary gear speed reduction device. The one-way clutch is composed of a clutch outer 29 that is rotated by the rotational torque outputted from the speed reduction device, a clutch inner 30 connected to the output shaft 4, and rollers 31 disposed between the clutch outer 29 and the clutch inner 30. When the rotational speed of the clutch outer 29 is higher than that of the output shaft 4, the rotational torque of the armature 10 is transmitted to the output shaft 4. On the other hand, when the rotational speed of the output shaft 4 (i.e., the rotational speed of the clutch inner 30) becomes higher than that of the clutch outer 29 due to a rotational torque of the engine cranked up, transmission of the rotational torque from the output shaft 4 to the armature 10 is interrupted.

Helical splines are formed on the inner bore of the pinion gear 5 and the outer periphery of the output shaft 4, and the pinion gear 5 is slidably coupled to the output shaft 4 by the splines. The pinion gear 5 is always biased toward the rear side by a biasing spring 32. The pinion gear 5 includes a flange 33 formed at its rear side, and the flange 33 has plural depressions 33*a* formed on the outer periphery thereof. A shutter 34, which is pushed against the front side of the pinion gear 5 by the biasing spring 32 and is slidably movable together with the pinion gear 5, is disposed to cover an opening of the front housing 12.

Figure 2:
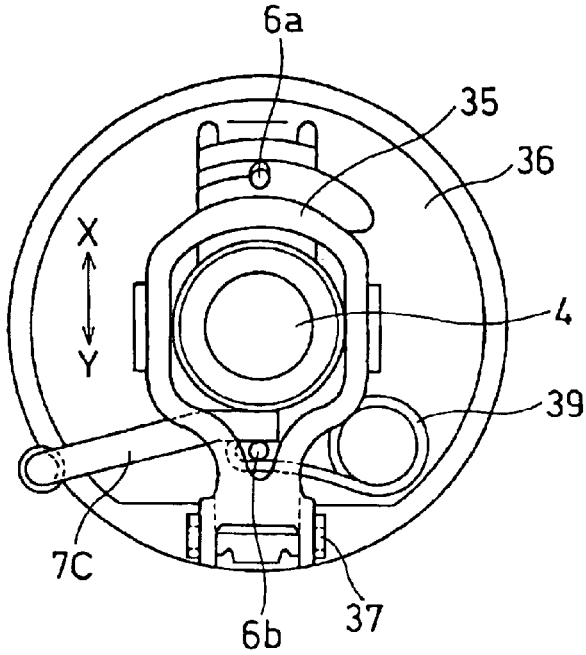
FIG. 2 is a plan view showing a ring for restricting a backward movement of a pinion and associated components, viewed from the front side of the starter.

At the rear side of the pinion gear 5, a ring 35, which prevents the pinion gear 5 from moving back toward the rear side in cooperation with the pinion-rotation-restricting member 6 after the pinion gear 5 is engaged with the ring gear 5, is disposed. The preventing ring 35, as shown in FIG. 2, includes an annular portion disposed around the output shaft 4. The preventing ring 35 is pivotally supported by a support 37 formed on a plate 36 and is connected to a thrust washer 38 disposed at the rear side of the flange 33. The plate 36 is positioned at a front side of the center case 26, thereby forming a space therebetween for accommodating the pinion-rotation-restricting member 6.

The pinion-rotation-restricting member 6 is formed by winding a metallic wire in a coil shape, for example, and is disposed in the space between the center case 26 and the plate 36. The pinion-rotation-restricting member 6 is disposed in the space so that it is movable in the direction X-Y shown in FIG. 2, while being always biased in direction X by a return spring 39. Both ends of the pinion-rotation-restricting member 6 are bent at a substantially right angle to the front side, as shown in FIG. 1, thereby forming an engaging portion 6*a* and an arm portion 6*b*. The engaging portion 6*a* engages with the depression 33*a* formed on the flange 33 when the pinion-rotation-restricting member 6 is moved downward, thereby restricting rotation of the pinion gear 5. The arm portion 6*b*, which is positioned opposite to the engaging portion 6*a* as shown in FIG. 2, engages with the return spring 39, thereby being biased upward.

As shown in FIG. 1, the crank bar 7 is composed of: a rod portion 7A, made of a metallic material such as S35C, extending in the axial direction; a coupling portion 7B connected to one end of the rod portion 7A at a substantially right angle; and an operating portion 7C formed at the other end of the rod portion 7A by bending the rod portion 7A. The rod portion 7A is disposed in parallel to the armature shaft 10*a* in the yoke 8 and is rotatably supported by a pair of bearings (not shown). The coupling portion 7B is made of a metallic material, such as SPCC, that is different from the material from which the rod portion 7A is made.

Figure 3:
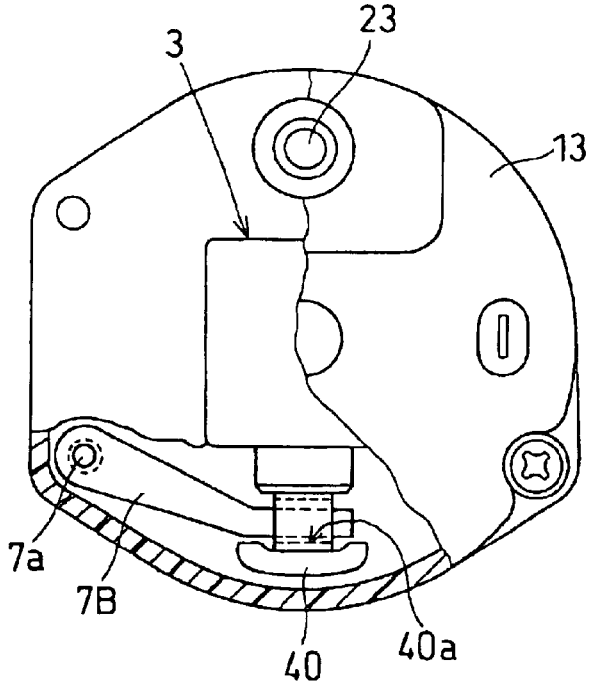
FIG. 3 is a partial cross-sectional view showing a coupling portion of a crank bar coupled to a plunger hook, viewed from the rear side of the starter.
Figure 4:
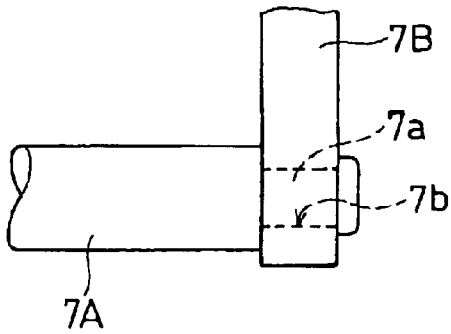
FIG. 4 is a partial side view showing the coupling portion of the crank bar connected to a rod portion.

One end of the coupling portion 7B is inserted into a coupling hole 40*a* formed in a hook 40 of the plunger 14, as shown in FIG. 3. The other end of the coupling portion 7B is connected to the rod portion 7A by inserting a connecting end 7*a* of the rod portion 7A into a hole 7*b* of the coupling portion 7B and by staking the connecting end 7*a,* as shown in FIG. 4. The coupling portion 7B is formed to have such a cross-section, e.g., a flat shape parallel to a plane perpendicular to the axial direction, that is not easily distorted when it is driven by the plunger 14. Further, the coupling portion 7B is hardened by heat treatment (e.g., carbonitriding treatment) to enhance its durability against abrasion.

The operating portion 7C is formed integrally with the rod portion 7A by bending one end of the rod portion 7A at a predetermined angle. As shown in FIG. 2, the operating portion 7C abuts against the arm portion 6*b* of the pinion-rotation-restricting member 6. When the crank bar 7 is rotated by the plunger 14, the operating portion 7C is driven downward (in the Y-direction in FIG. 2) and pushes down the pinion-rotation-restricting member 6 against a biasing force of the return spring 39.

Now, operation of the starter described above will be explained. Upon closing the ignition switch, electric current is supplied to the solenoid 15 of the magnetic switch 3. The plunger 14 is attracted by the magnetic force generated in the solenoid 15 and is moved upward (in FIG. 1). The crack bar 7 is rotated according to the upward movement of the plunger 14, and thereby the pinion-rotation-restricting member 6 is pushed downward (in Y-direction of FIG. 2). The engaging portion 6*a* of the pinion-rotation-restricting member 6 engages with the depression 33*a* formed on the flange 33 of the pinion gear 5. Thus, the rotation of the pinion 5 is restricted.

On the other hand, according to the upward movement of the plunger 14, the auxiliary movable contact 18 contacts the auxiliary stationary contact 20. Electric current is supplied from the on-board battery to the armature 10 through the starting resistor 24, the auxiliary switch composed of the auxiliary movable contact 18 and the auxiliary stationary contact 20 and the brushes 11. The armature 10 rotates at a low speed. The rotational speed of the armature 10 is reduced by the speed reduction mechanism and is transferred to the output shaft 4 through the one-way clutch.

The pinion gear 5 spline-coupled to the output shaft 4 does not rotate since its rotation is restricted by the pinion-rotation-restricting member 6. Instead, the pinion gear 5 is pushed forward toward the ring gear R of the engine according to the rotation of the output shaft 4. Thus, the pinion gear 5 engages with the ring gear R. As the pinion gear 5 engages with the ring gear R, the engaging portion 6*a* is disengaged from the depression 33*a* of the flange 33. At the same time, the backward movement (toward the rear side) of the pinion gear 5 is restricted by the ring 35. Thus, the pinion gear 5 is brought to a position to be driven by the output shaft 4 while keeping engagement with the ring gear R.

As the upward movement of the plunger 14 further proceeds, the main movable contact 17 abuts with the main stationary contact 19. Full electric current is supplied to the armature 10 through the main switch. Thus, the armature 10 rotates at a full speed, and the engine is cranked up by the rotational torque of the pinion gear 5 transferred from the armature 10.

After the engine is cranked up, the ignition switch is turned off, and the magnetic force in the solenoid 15 disappears. The plunger 14 is pushed back to its original position by the return spring 16. According to this movement of the plunger 14, the crank bar 7 rotates back to its original position, thereby releasing its force pushing the arm portion 6*b* downward (in Y-direction in FIG. 2). The pinion-rotation-restricting member 6 is moved upward (in X-direction in FIG. 2), and the engaging portion 6*a* comes out of the rear surface of the ring 35. Thus, the restriction of the backward movement of the pinion gear 5 is released, and the pinion gear 5 is pushed back to its original position (shown in FIG. 1) by the biasing force of the return spring 32.

Since the crank bar 7 is divided into two portion, i.e., the integral portion consisting of the rod portion 7A and the operating portion 7C and the coupling portion 7B, the crank bar 7 can be easily assembled in the starter 1. The coupling portion 7B is first connected to the hook 40 of the plunger 14 as shown in FIG. 3, and then the rod portion 7A is connected to the coupling portion 7B as shown in FIG. 4. A connecting end 7*a* of the rod portion 7A is inserted into a hole 7*b* of the coupling portion 7B, and the connecting end 7*a* is staked. If the entire crank bar 7 is integrally formed, it is difficult to assemble the crank bar 7 at its right position and with right angles with respect to portions to which the crank bar 7 is connected. Further, by separating the crank bar 7 into two portions, it is possible to assemble the starter sequentially from its one side, e.g., from the front side. Namely, the front housing 12 is placed at the bottom, and all other components can be stacked up thereon. This makes a mass production process simple and easy.

Further, it is possible to make the two portions of the crank bar 7 from respectively different materials. For example, the rod portion 7A may be made of S35C while making the coupling portion 7B of SPCC. Both portions may be formed to have respectively different cross-sections. For example, the coupling portion 7B may be made to have a flat cross-sectional shape in the axial direction to enhance its strength against distortion caused by the pulling force of the plunger 14. On the other hand, the rod portion 7A may be made to have an oval cross-section that shows a higher strength against a twisting force. If the crank bar is made in a single unit, it is difficult to give different cross-sections to respective portions.

It is also possible to harden only the coupling portion 7B by heat treatment. Since one end of the coupling portion 7B is inserted into the coupling hole 40*a* and slidably coupled thereto, as shown in FIG. 3, it is required to give the coupling portion anti-abrasion property. By separating the coupling portion 7B form the other portion, the heat treatment can be easily done only for the coupling portion 7B. Moreover, after the coupling portion 7B and the operating portion 7C are connected to the respective components at correct angles, both portions (the coupling portion 7B and the portion including the rod portion A and the operating portion 7C) can be connected to each other. Therefore, it is not required to make the angle of the coupling portion 7B relative to the rod portion 7A exactly correct. Also, it is not required to strictly control preciseness of dimensions of the electromagnetic switch 3 or other components because some adjustment is possible when the coupling portion 7B is connected to the rod portion 7A.

Figure 5:
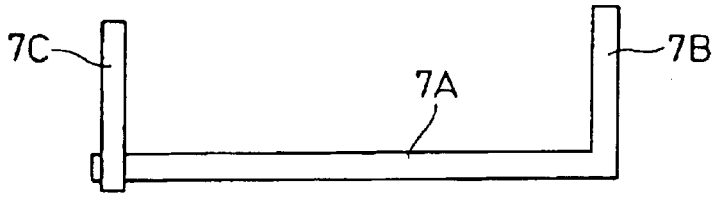
FIG. 5 is a side view showing a rod portion having a coupling portion, the rod portion being connected to an operating portion.

As shown in FIG. 5, the crank bar 7 may be divided into two portions, i.e., the operating portion 7C and the other unitary portion consisting of the rod portion 7A and the coupling portion 7B. The similar advantages mentioned above can be obtained in this modified form, too. In this case, the starter 1 can be assembled by placing the rear end cover 13 at the bottom and sequentially building up other components thereon in a mass production process. It is also possible to enhance an anti-abrasion property of the operating portion 7C by heat treatment.

Figure 6:
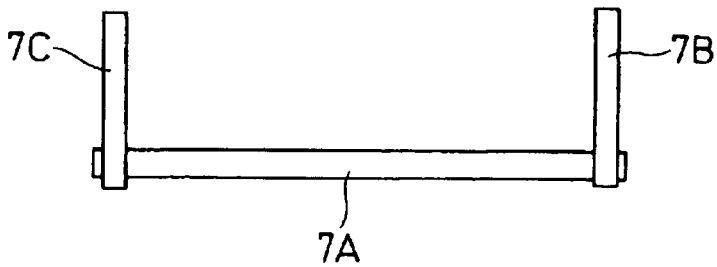
FIG. 6 is a side view showing a rod portion of the crank bar connected to a coupling portion and to an operating portion.

As shown in FIG. 6, it is also possible to divide the crank bar 7 into three portions, i.e., the rod portion 7A, the coupling portion 7B and the operating portion 7C. In this case, after the coupling portion 7B and the operating portion 7C are correctly positioned or connected to respectively right positions in the starter 1, both portions 7B and 7C are connected to the rod portion 7A. In this case, a bending process can be completely eliminated in the process of forming the crank bar 7.

The present invention is not limited to the embodiment described above, but it may be variously modified. For example, the coupling portion 7B can be connected to the rod portion 7A in manners other than the one shown in FIG. 4. The rod portion 7A and the coupling portion 7B may be connected to each other by welding, screwing or the like. The same is applied to the connecting portions shown in FIGS. 5 and 6, too.

While the present invention has been shown and described with reference to the foregoing preferred embodiment, it will be apparent to those skilled in the art that changes in form and detail may be made therein without departing from the scope of the invention as defined in the appended claims.

What is claimed is:

1. A starter for cranking an internal combustion engine having a ring gear, the starter comprising:

an electric motor;

an output shaft driven by the electric motor;

a magnetic switch for driving a plunger by magnetic force generated therein, electric power supply to the electric motor being controlled in an on-and-off fashion in response to movement of the plunger;

a pinion gear movable in an axial direction of the starter;

a pinion-rotation-restricting member adapted to engage with the pinion gear to restrict rotation of the pinion gear; and a crank bar driven by the plunger for bringing the pinion-rotation-restricting member into engagement with the pinion gear, thereby thrusting the pinion gear in the axial direction toward the ring gear of the internal combustion engine and establishing engagement between the pinion gear and the ring gear, wherein:

the crank bar is composed of a first portion and a second portion, formed as separate pieces the first portion consisting of a rod portion extending in the axial direction of the starter and an operating portion being bent from the rod portion and contacting the pinion-rotation-restricting member, the second portion consisting of a coupling portion coupled to the plunger of the magnetic switch; and the first portion and the second portion are made of respectively different materials.

2. The starter as in claim 1, wherein:

the coupling portion is hardened by heat treatment to provide abrasion durability.

3. The starter as in claim 1, wherein:

the first portion and the second portion have respectively different cross-sections.

* * * * *